US006319319B1

(12) United States Patent
Yu

(10) Patent No.: US 6,319,319 B1
(45) Date of Patent: Nov. 20, 2001

(54) COATING SPREADING MACHINE

(76) Inventor: Chin-Lung Yu, No. 13, Lane 7, Jen Mei, Pei Tun District, Taichung (TW)

( * ) Notice: Subject to any disclaimer, the term of this patent is extended or adjusted under 35 U.S.C. 154(b) by 0 days.

(21) Appl. No.: 09/432,206

(22) Filed: Nov. 3, 1999

(51) Int. Cl.[7] ..... B05C 1/08

(52) U.S. Cl. ..... 118/262; 118/258; 118/235; 118/67

(58) Field of Search ..... 118/235, 244, 118/245, 256, 325, 249, 250, 103, 117, 126, 58, 67, 68, 259, 304, 258, 261, 262; 427/258, 411; 101/424.2

(56) References Cited

U.S. PATENT DOCUMENTS 3,078,179 * 2/1963 Kuhn et al. ..... 427/314
5,817,215 * 10/1998 Kinnunen ..... 162/193
5,972,113 * 10/1999 Le Riche et al. ..... 118/643

* cited by examiner

*Primary Examiner*—Laura Edwards
*Assistant Examiner*—Yewebdar T. Tadesse
(74) *Attorney, Agent, or Firm*—Rosenberg, Klein & Lee

(57) ABSTRACT

A coating spreading machine for spreading resin onto a printed layer film of a plastic tile is provided. The printed layer film is rolled up around a roller and then fed to the spreading machine. The spreading machine has a coating spreading device and a drying device; the spreading device includes a transmission wheel capable of turning, a steel wheel arranged under the transmission wheel, a nozzle and a pressing wheel arranged above the transmission wheel. The printed layer film is passed through between the transmission wheel and the pressing wheel, and then fed to the drying device. The nozzle ejects resin onto the transmission wheel; the resin is then spreaded even on the transmission wheel by means of the steel wheel. The resin spreaded on the transmission wheel is then coupled to the printed layer film by means of the pressing wheel. The printed layer film is thus applied with resin and can be coupled to a basic part of a plastic tile.

3 Claims, 3 Drawing Sheets

COATING SPREADING MACHINE

BACKGROUND OF THE INVENTION

The present invention relates to a coating spreading machine, and particularly to one which can apply protective resin layer onto a top layer of a plastic tile.

Referring to FIG. 4, a common plastic tile consists of a basic part 10, an intermediate part 101 and a printed layer 102 having design thereon; the intermediate part 101 is provided for making the printed layer to be seen clearly. Protective resin 103 is applied onto the printed layer 102 in order for the printed layer 102 to be well protected.

The manufacturing process of using a heretofore known resin spreading machine includes the following steps:

(1) preparing a roller of printed layer, and preparing a roller of intermediate part;

(2) feeding a basic part of plastic tile by a feeding machine;

(3) combining the printed layer and the intermediate part with the basic part by using a rolling machine; the printed layer and the intermediate part are firmly coupled to the basic part after being rolled over by the rolling machine;

(4) cutting the above said semi-finished plastic tile into pieces of predetermined size;

(5) sending the pieces of semi-finished products to a coating spreading factory for applying resin onto the printed layer; and drying same after application of the resin;

(6) sending the finished products back to the original factory.

It is found that the above process has undesirable features as follows.

1. After the semi-finished products are cut into pieces, they have to be delivered to another factory for applying the resin layer thereonto. Consequently, the cost increases due to the extra delivery.
2. After the printed layer and the intermediate part are coupled to the basic part, the semi-finished products are cut into pieces and delivered to another factory. So, the semi-finished tiles are likely to be damaged during the cutting and under the delivery.
3. Because the printed layer is coupled to the basic part before application of the resin, the protective resin cannot be evenly spreaded on the printed layer very easily with the prior art resin spreading machine.

SUMMARY OF THE INVENTION

Therefore, it is a main object of the present invention to provide a coating spreading machine, by which the process of making a plastic tile with protective resin thereon can be simplified, and have relatively low failure rate of the products.

The coating spreading machine of the present invention comprises:

a feeding device for feeding a printed layer film rolled up on a roller;

a coating spreading device including:

(i) a transmission wheel being capable of turning with a transmission device (ii) a nozzle capable of ejecting liquid resin onto said transmission wheel;

(iii) a steel wheel arranged under said transmission wheel for making said liquid resin to be evenly spreaded on said transmission wheel, the space between the transmission wheel and the steel wheel being adjustable to controlling the thickness of the resin spreaded on the transmission wheel;

(iv) a pressing wheel arranged adjacent to said transmission wheel, said printed layer film being passed through between said transmission wheel and said pressing wheel for said resin spreaded on said transmission wheel to be coupled to said printed layer film by means of said pressing wheel;

a drying device arranged above said coating spreading device for drying said resin coupled to said printed layer film; and, a rolling device provided for rolling up said printed layer film around a roller after said film with resin coupled thereto comes out of said drying device.

The coating spreading machine of the present invention can combine the printed layer film with the resin directly before same is coupled to a basic part of a plastic tile. The process for making a plastic tile is relatively simple and the failure rate of the product is reduced.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
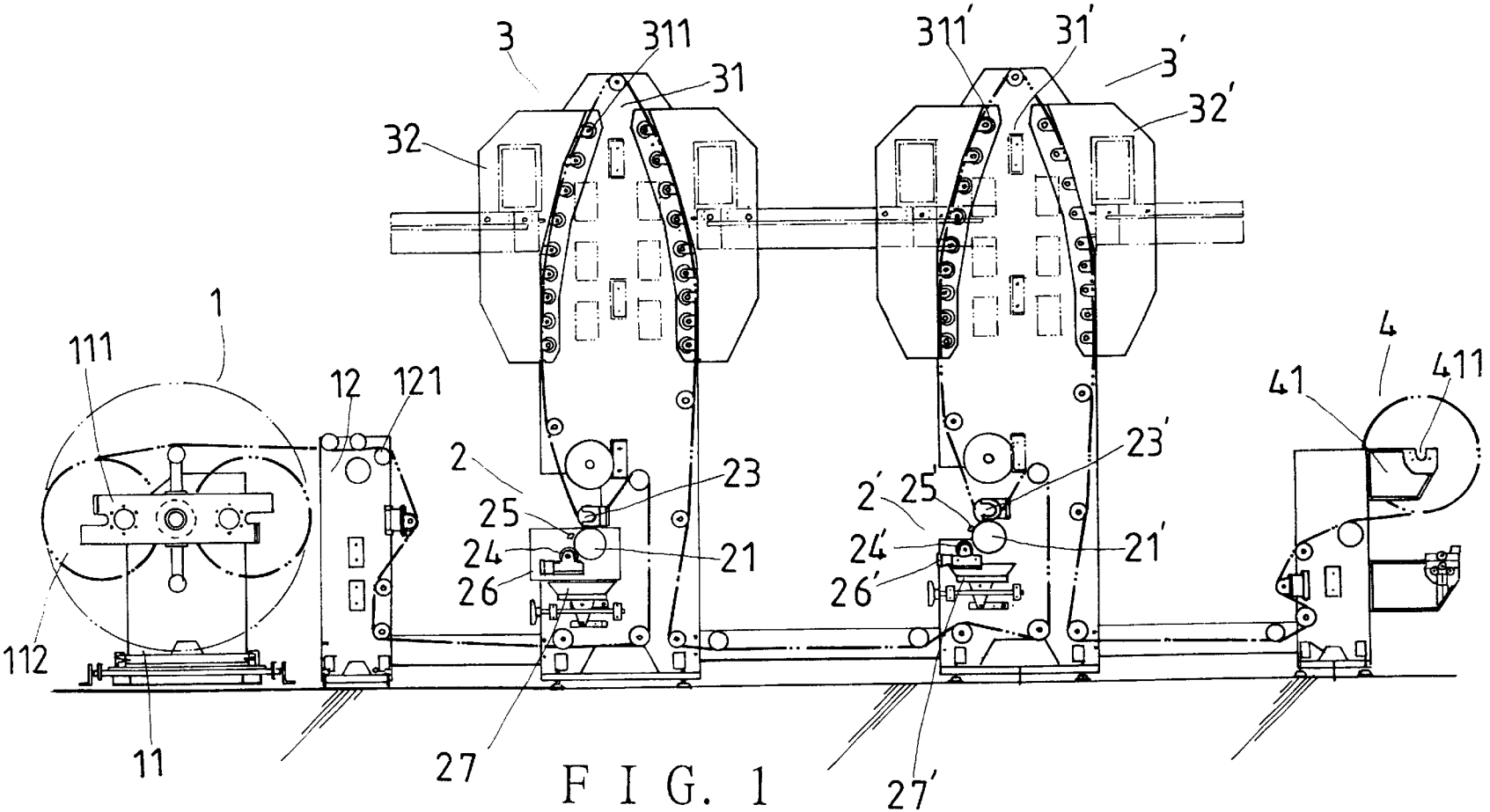
FIG. 1 is a view showing the structure of the coating spreading machine of the present invention.

Referring to FIG. 1, a coating spreading machine of the present invention comprises a feeding device 1, a first and a second coating spreading device 2, 2', a first and a second drying devide 3, 3' and a rolling-up device 4.

The feeding device 1 includes a support member 11 and a feeding member 12. The support member 11 has a supporter 111 for a roll of printed layer film having design thereon 112 to be fitted thereon such that the roll of printed layer film 112 can be rolled. The feeding member 12 has several rollers 121 provided for sending the printed layer film 112 with a certain tightness.

The coating spreading devices 2, 2' are located under the drying devices 3, 3' respectively. The coating spreading devices 2, 2' are arranged such that the printed layer film 112 is fed through the first coating spreading device 2, the first drying device 3, the second coating spreading device 2' and the second drying device 3' in sequence.

Figure 2:
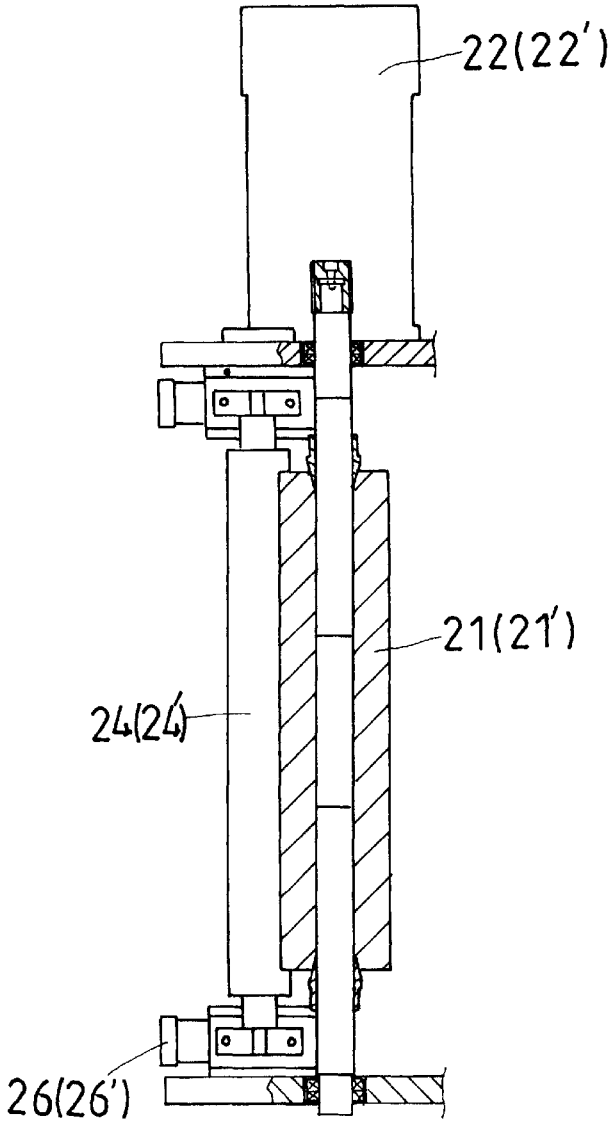
FIG. 2 is a top view of a resin spreading device of a coating spreading machine in FIG. 1.
Figure 3:
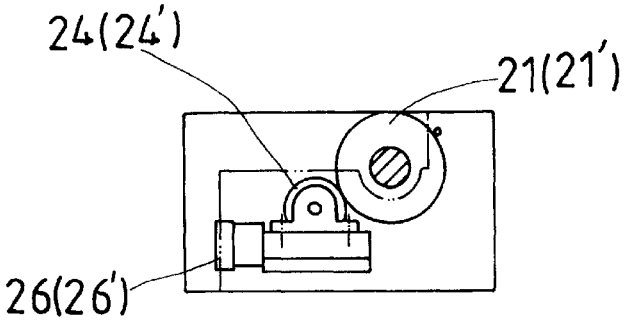
FIG. 3 is a fragmentary side view of the resin spreading device of the coating spreading machine in FIG. 1.
Figure 4:
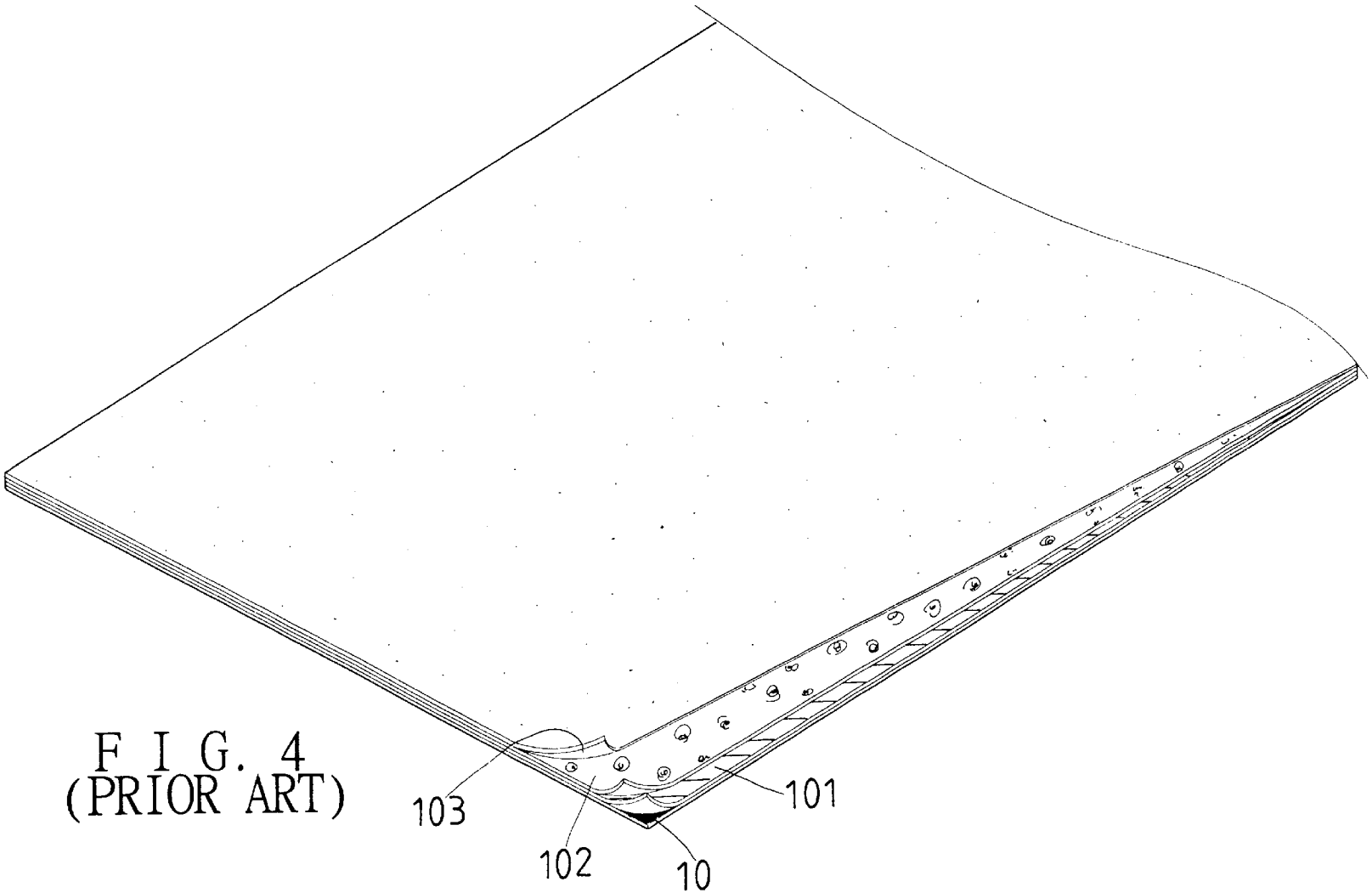
FIG. 4 (PRIOR ART)
FIG. 4 is a view showing the configuration of a plastic tile.

The first coating spreading device 2 has a transmission device 22, a transmission wheel 21, a pressing wheel 23, a steel wheel 24, a nozzle 25 and an adjustment device 26. Referring to FIG. 2, the transmission device 22 provides power to the transmission wheel 21 such that the wheel 21 can turn. The steel wheel 24 is arranged under the transmission wheel 21. The nozzle 25 is arranged such that it can eject liquid resin onto the transmission wheel 21. The pressing wheel 23 is arranged above the transmission wheel 21.

The printed layer 112 is fed into the first coating spreading device, and passed through between the first transmission wheel 21 and the pressing wheel 23. Then, the printed layer film 112 is sent through the first drying device 3, and thirdly to the second coating spreading device 2'. The second coating device 2' has a transmission device 22', a transmission wheel 21', a pressing wheel 23', a steel wheel 24', a nozzle 25' and an adjustment device 26', which have the same functions and connections as those of the first spreading device 2, and therefore are not detailed again here.

In using the coating spreading machine, the nozzles 25, 25' eject liquid resin onto the transmission wheel 21, 21'. Then, the steel wheels 24, 24' help the resin to be evenly spreaded on the transmission wheels 21, 21' when the transmission wheels 21, 21' are truning. The thickness of the resin spreaded on the transmission wheels 21, 21' can be adjusted by controlling the adjustment devices 26, 26' to change the space between the wheels 21, 21' and the steel wheel 24, 24'. Then, the resin on the wheels 21, 21' are coupled to the printed layer 112 fed through between the wheels 21, 21' and the pressing wheels 23, 23'. The pressing wheels 23, 23' press the printed layer 112 onto the transmission wheel for same to be connected to the resin firmly.

The coating spreading devices 2, 2' each further has a holding plates 27, 27' located at the lower side thereof for receiving the surplus part of the resin that has fallen off the transmission wheel.

The drying devices 3, 3' each has a roller set 31, 31'. The roller sets 31, 31' each has several rollers 311, 311'. The drying devices 3, 3' each further has a drying air box 32, 32' arranged outwardly of the roller sets 31, 31'. After the printed layer 112 and the resin are connected by the first coating spreading device 2, they are fed to the first drying device 3 along the roller set 31 and dried by air from the drying air box 32.

After the printed layer 112 is dried by the first drying device 3, it is fed to the second coating spreading device 2' for a second resin layer to be applied thereon. Next, the printed layer 112 is dried by the second drying device 3'.

After the printed layer 112 comes out of the second drying device 3', it is fed to the rolling-up device 4 arranged next to the second spreading device 2'. The rolling-up device 4 has a supporter 41 and a roller 411 supported by the supporter 41. The printed layer 112 is rolled up around the roller 411.

The printed layer 112 with the protective resin layer coupled thereto is then connected to an intermediate part of a plastic tile. And, the intermediate part is connected to a basic part of the tile; the basic part is then cut to become a finished plastic tile product.

The coating spreading machine can also be used for directly spreading resin onto an intermediate part which has wood grains or other patterns thereon without a printed layer film. The intermediate part is then directly coupled to a basic part of a plastic tile.

In a second embodiment of the present invention, the nozzles 25, 25' are made to eject dye onto the transmission wheels 21, 21' for spreading the dye on the other side of the printed layer, which already has protective resin layer as in the last process. Thus, the printed layer 112 can be directly connected to the basic part without an intermediate part.

From the above description, it can be understood that the coating spreading machine of the present invention has advantages as follows.

1. It can combine the printed layer with the resin directly before the printed layer is coupled to the basic part of the tile. So, the basic part can be cut after the printed layer and the resin are connected thereto to become a finished tile product, and do not have to be delivered to another factory as the heretofore known process using the prior art machine. Therefore, the cost and the failure rate become lower. And, the process is simplified.
2. The coating spreading machine can also spread dye onto the other side of the printed layer to replace the intermediate part used for making the design of the printed layer seen clearly. Therefore, the material cost is further decreased.
3. There can be as many coating spreading devices and drying devices as needed in the machine of the present invention for controlling the thickness of the resin layer.
4. The transmission wheel and the steel wheel can help the resin to be evenly spreaded onto the printed layer.

What is claimed is:

1. A coating spreading machine comprising (a) a feeding device including a support member and a feeding member, said support member supporting a roll of printed layer film for support same to be capable of rolling thereon, said feeding member having a plurality of rollers for said printed layer film to be fed therethrough;

(b) a first coating spreading device having
- (i) a transmission wheel;
- (ii) a transmission device providing power to said transmission wheel for same to be capable of turning;
- (iii) a nozzle capable of ejecting liquid resin onto said transmission wheel;
- (iv) a steel wheel arranged under said transmission wheel for making said liquid resin spreaded on said transmission wheel;
- (v) a pressing wheel arranged adjacent to said transmission wheel, said printed layer film being passed through between said transmission wheel and said pressing wheel for permitting said resin spreaded on said transmission wheel to be coupled to said printed layer film by means of both said transmission wheel and said pressing wheel;

(c) a first drying device said drying device being arranged above said coating spreading device, having a roller set and a drying air box located next to said roller set, said printed layer having said resin coupled thereto being fed to said drying device, passed around said roller set for permitting air of said drying air box to dry said resin; and, (d) a rolling-up device arranged next to said coating spreading device for rolling up said printed layer film having said resin applied thereonto.

2. The coating spreading machine as claimed in claim 1, wherein said nozzle can be used to eject a white dye for same to be spreaded onto other side of said printed layer film.

3. The coating spreading machine as claimed in claim 1, wherein there are plurality of second coating spreading devices like said first spreading device arranged between said first coating spreading device and said rolling-up device, and second drying device same as said first drying device each located above a corresponding one of said second coating spreading devices.

* * * * *